US008789232B2

(12) United States Patent
Sullivan et al.

(10) Patent No.: US 8,789,232 B2
(45) Date of Patent: Jul. 29, 2014

(54) PERSONAL HYGIENE DEVICE

(75) Inventors: Ann Sullivan, Schaumburg, IL (US); Steven Ward, Lake in the Hills, IL (US); Leon C. Clouser, Jr., Lombard, IL (US); Nick Jackson, Carol Stream, IL (US); Kristian Buschmann, Chicago, IL (US); Jon Strommen, Ramsey, MN (US)

(73) Assignee: Helping Hand Products, Inc., Schaumburg, IL (US)

( * ) Notice: Subject to any disclaimer, the term of this patent is extended or adjusted under 35 U.S.C. 154(b) by 77 days.

(21) Appl. No.: 13/507,878

(22) Filed: Aug. 4, 2012

(65) Prior Publication Data

US 2014/0037363 A1 Feb. 6, 2014

(51) Int. Cl.
*A47K 7/08* (2006.01)
*A47L 13/46* (2006.01)

(52) U.S. Cl.
USPC ..... 15/210.1; 15/209.1; 15/231; 294/119.3; 604/1

(58) Field of Classification Search
USPC ..... 15/209.1, 210.1, 211, 212, 231, 232; 294/119.3, 196; 604/1
See application file for complete search history.

(56) References Cited

U.S. PATENT DOCUMENTS 2,580,226 A * 12/1951 Hempel ..... 15/210.1
2,816,313 A 12/1957 Beck et al.
2,998,614 A 9/1961 Winch
4,075,033 A * 2/1978 Knox et al. ..... 134/6
5,067,194 A 11/1991 Rosenfeld et al.
5,323,507 A * 6/1994 Tosato ..... 15/231
5,862,564 A 1/1999 Hamm
5,875,512 A 3/1999 Lathan
6,145,154 A 11/2000 Blair
6,158,077 A * 12/2000 Wenger et al. ..... 15/210.1
D439,977 S 4/2001 Wenger et al.
6,272,716 B1 8/2001 Thornton
6,546,587 B2 * 4/2003 Christiansen ..... 15/231
6,689,224 B1 2/2004 Hillman
6,955,662 B2 10/2005 Moser
6,981,293 B2 1/2006 Steinberg
7,059,008 B2 6/2006 Morgan et al.

(Continued)

FOREIGN PATENT DOCUMENTS

GB 2424173 A 9/2006

OTHER PUBLICATIONS

Buckingham compacteasywipe user instructions www.buckinghamhealthcare.co.uk.

(Continued)

*Primary Examiner* — Mark Spisich
(74) *Attorney, Agent, or Firm* — Greenberg Traurig, LLP

(57) ABSTRACT

A personal hygiene device is provided to assist a user to wipe him or herself, another, or an area of the home. The device contains a gripping head constructed of a flexible material and contains a gripping element, which may hold a wipe within it. The device also contains a rigid housing, and a pump at the opposite end of the gripping head, such that upon actuation of the pump increased fluid pressure inside the gripping head opens the internal grips to an extent that any wipe held therein will be released. In an embodiment of the invention, the housing contains a hinge so the unit may be folded for storage, or extended and locked in place for use.

18 Claims, 8 Drawing Sheets

(56) References Cited

U.S. PATENT DOCUMENTS

| | | | |
|---|---|---|---|
| 7,249,392 | B1 | 7/2007 | Pallie |
| 7,581,276 | B2 | 9/2009 | Endo et al. |
| 7,698,773 | B2 | 4/2010 | Satelo |
| 2008/0028557 | A1 | 2/2008 | Klaes |
| 2009/0159487 | A1 | 6/2009 | Tacoma |

OTHER PUBLICATIONS

The Buckingham Compact Easywipe, http://www.buckinghamhealthcare co.uk/shop/help-in-the-bathroom-c-36/the-buckingham, printed Mar. 10, 2011.

* cited by examiner

PERSONAL HYGIENE DEVICE

BACKGROUND OF THE INVENTION

1. The Technical Field

The present invention is directed to a personal hygiene device, for assisting a person in cleaning, e.g., soiled, hard-to-reach surfaces, whether on the body, or in the user's environment.

2. The Prior Art

Personal hygiene devices are used by people to clean themselves, others (such as by health care providers) or surfaces of their home. While many people clean themselves, or, as caregivers, clean others, with toilet paper, towelettes, etc., by holding the towel or wipe directly in their hands, there are others who cannot or choose not to do so. Similarly, many people directly hold towels or wipes to clean surfaces in their environments, while others cannot or is choose not to do so. Elderly or disabled persons who have impaired mobility, or persons of a fastidious nature, can benefit from using a personal hygiene device to clean themselves and discard used toilet paper into a toilet bowl. Similarly, a personal hygiene device may be used by someone to apply ointment or cream to an area of their, or someone else's, body with a wipe containing such an ointment or cream. Finally, a personal hygiene device may also be used to wipe parts of one's home that may be hard to reach, or that a user would rather not wipe directly, such as a toilet bowl, sink, shower stall, or bathtub. In all of these cases, the personal hygiene device assists the user to wipe or clean areas, that the user cannot or chooses not to, address with a towel, wipe or toilet paper sheet held directly with their hand.

A personal hygiene device allows the user to attach a wipe, such as toilet paper, a towlette, a cotton ball or swab, etc. at one end of the personal hygiene device, holding the personal hygiene device at the other end, and maneuvering the personal hygiene device such that the end with the wipe attached to it will wipe the desired area. Such a personal hygiene device may be shaped with a slight bend to allow for easier handling and use.

A personal hygiene device also allows the user to release the wipe, into a toilet bowl, garbage can, or the like, without the user having to directly touch the soiled wipe. In prior art devices, the hands-free release is usually done through a purely mechanical actuation, such as by depressing a switch or pressing a button, which in turn causes a linkage to cause the end holding the wipe to release it, allowing the soiled wipe to fall into a receptacle below. While mechanical actuation is known to be effective, the additional moving parts add cost and weight to a personal hygiene device, and may more easily break or become disjointed with repeated use.

It would be desirable to provide a personal hygiene device having a simplified, yet reliable construction and operating structure. It would also be desirable to provide a personal hygiene device that is constructed for easier storage and portability.

It would be desirable to provide a personal hygiene device with the benefits of hands-free release and easy storage, while offering improved reliability and lower cost.

These and other desirable characteristics of the present invention will become apparent in light of the present specification, including the claims, and drawings.

SUMMARY OF THE INVENTION

The present invention comprises a personal hygiene device.

The personal hygiene device includes a housing, a pump and a gripping head. The gripping head incorporates one or more gripping elements which are capable of holding a wipe in place when it is inserted by the user. The gripping element contains internal grips that are capable of holding a wipe in place between them. After being loaded with a wipe, the user holds the pump and/or housing to wipe him or herself, or another person, or a surface of the home, with the wipe attached to the gripping head as needed.

The pump and gripping head are manufactured of a flexible material, that may be squeezed, and that also allows its shape to expand when increased internal fluid pressure is applied. The flexible material also allows the pump and gripping head to return to their original shapes when the pump is no longer squeezed, and fluid pressure is equalized to the gripping head.

During the intended use, for example, the user wipes him or herself with a wipe as needed. After the user has finished using that wipe, the user can release the wipe through pneumatic actuation. Squeezing the pump forces fluid into the gripping head, which in turn expands. The gripping head bulges outwardly such that the internal grips open and no longer hold the wipe in the gripping element, permitting the wipe to fall into a toilet bowl or other receptacle. When the pump is released, fluid pressure equalizes to the gripping head such that it returns to its original shape, and may be re-loaded with a fresh wipe.

The housing is preferably made of a substantially rigid material, such that when a user is holding the device in use, its shape will not change, nor will it bend, under ordinary usage, when a user is attempting to wipe him or herself. A rigid housing allows the user to more easily control the positioning of the gripping head containing a wipe. The housing may be constructed in one or more pieces, to allow for cost-effective manufacturing and assembly of the device.

In an embodiment of the invention, a transmission tube and tube fittings are disposed inside the housing, pneumatically connecting the pump and gripping head, to allow air or another fluid to travel from the pump when squeezed, to the gripping head, to expand the gripping head to release a wipe during the intended use of the device. Subsequently, when the pump is released, the transmission tube and tube fittings allow the fluid in the gripping head to equalize the fluid pressure in the pump, and allow the pump and gripping head to return to their original shapes. The transmission tube and tube fittings are connected to the pump and gripping head in such a manner that a seal is formed, such that the fluid will not leak from the device when the pump is squeezed. This will cause the fluid pressure in the gripping head to increase to a sufficient amount to expand the gripping element to release any wipe it may hold.

In an embodiment of the invention, the personal hygiene device includes a hinge and a locking mechanism associated therewith, such that it may be folded for storage or portable transport, and also extended and locked in place for use.

DETAILED DESCRIPTION OF THE INVENTION

Figure 1:
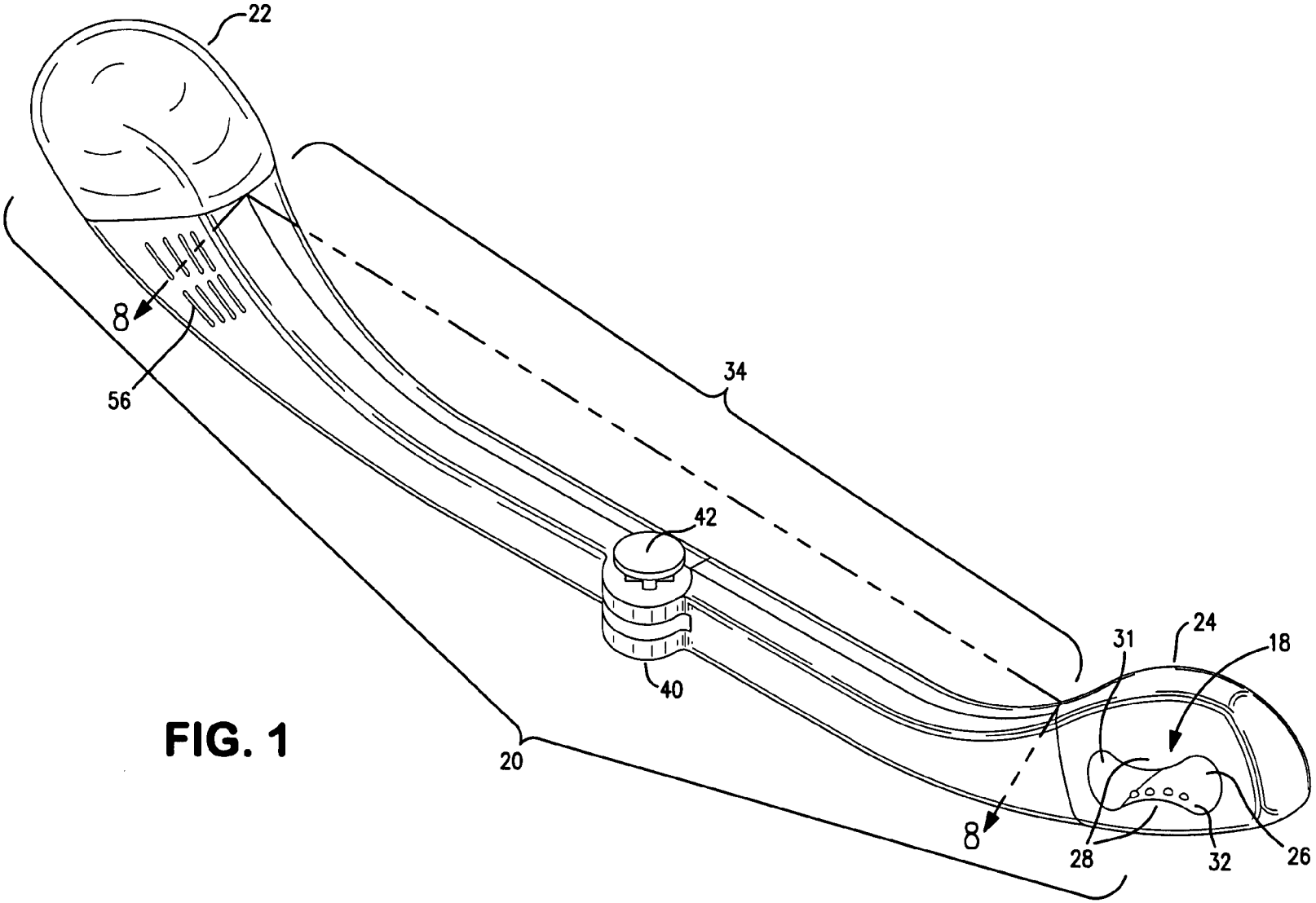
FIG. 1 is a perspective view of the personal hygiene device according to a preferred embodiment of the invention, showing the personal hygiene device in an open and locked configuration, for use.

While this invention is susceptible of embodiment in many different forms, there is shown and described in the drawings and associated text, a specific embodiment, with the understanding that the present disclosure is to be considered an exemplification of the principles of the invention and is not intended to limit the invention to the embodiment illustrated.

The following description and drawings are illustrative and are not to be construed as limiting. Numerous specific details are described herein to provide a thorough understanding of the disclosure. However, in certain instances, well-known or conventional details may not be described in order to avoid obscuring the description. References to one, or an, embodiment in the present disclosure can be, but not necessarily are, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments, but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and in no way limits the scope and meaning of the disclosure or of any exemplified term. Likewise, the disclosure is not limited to various embodiments given in this specification.

Unless otherwise specifically defined herein, all technical and scientific terms used herein have the same meaning as commonly understood by one of ordinary skill in the art to which this disclosure pertains. In the case of conflict, the present document, including definitions, will control.

For purposes of this detailed description, it is envisioned that in one example of use of the invention, a user will be sitting on a toilet while using the personal hygiene device, and using the personal hygiene device to wipe him- or herself in the perineal region with toilet paper. During this process, the user would load one or more pieces of toilet paper into the personal hygiene device, wipe him or herself with the toilet paper held by the personal hygiene device, and then, by squeezing the pump, release the toilet paper into the toilet bowl. This description is not meant to limit the scope of the claims, but rather to describe one embodiment of the invention.

Figure 7:
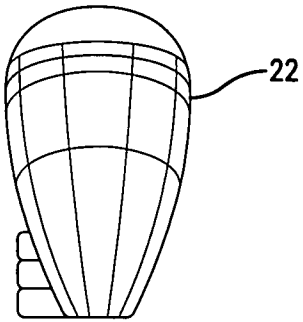
FIG. 7 is a view from the pump end of the personal hygiene device according to the embodiment of FIG. 1.
Figure 6:
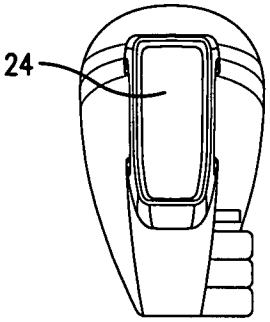
FIG. 6 is a view from the gripping head end of the personal hygiene device according to the embodiment of FIG. 1.

Personal hygiene device 20, as shown in FIGS. 1, 6 and 7, comprises pump 22 and gripping head 24, are constructed of a substantially resilient plastic material such as silicone, fluorosilicone, or a similar material that offers flexibility, durability, and "memory"—the ability of the part to return to the same shape, after having been squeezed or everted by fluid pressure, and the externally applied force subsequently removed). Pump 22 and gripping head 24 should be constructed of a material that may be hygienically cleaned for repeated use. Pump 22 and gripping head 24 may be monolithically formed, e.g., as a single blow-molded or injection-molded part. Alternatively, one or both may be formed from two or more components which are then joined together, e.g., by sonic welding, adhesive or similar technique.

Figure 12:
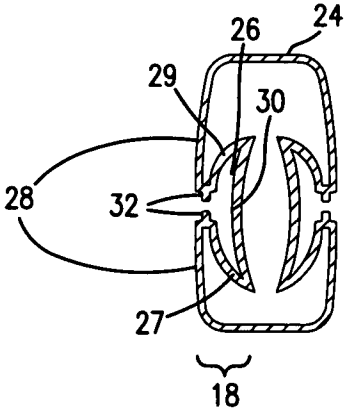
FIG. 12 is a cross sectional view of the gripping head with two gripping elements, taken along lines 11-11 of FIG. 5, and looking in the direction of the arrows, showing the internal grips in the closed position, according to the embodiment of FIG. 1.
Figure 11:
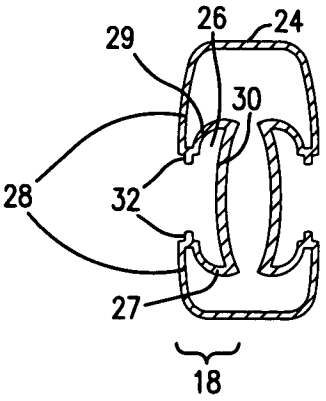
FIG. 11 is a cross sectional view of the gripping head with two gripping elements, taken along lines 11-11 of FIG. 4, and looking in the direction of the arrows, showing the internal grips in the open position, according to the embodiment of FIG. 1.

Gripping head 24 contains at least one gripping element 18, the details of which are shown in the cross section views of FIGS. 11 and 12. Gripping element 18 contains opening 26, one set of internal grips 28, back surface 30, bottom surface 27, top surface 29, and side surfaces 31. Internal grips 28 are constructed such that when the fluid pressure is equalized (the same pressure inside gripping head 24 as outside), internal grips 28 are closed and pressed tight enough to hold a wipe in place while being rubbed against a person or soiled area. When the fluid pressure inside gripping head 24 is increased, gripping head 24 will, at least in part, expand like a balloon. As internal grips 28 are a contiguous part of gripping head 24 and constructed of the same material, internal grips 28 also expand when increased fluid pressure is applied. During this expansion, the internal grips 28 are separated from each other, or "opened," through the eversion of gripping element 18, and thus release the wipe that internal grips 28 may have been holding.

Figure 9:
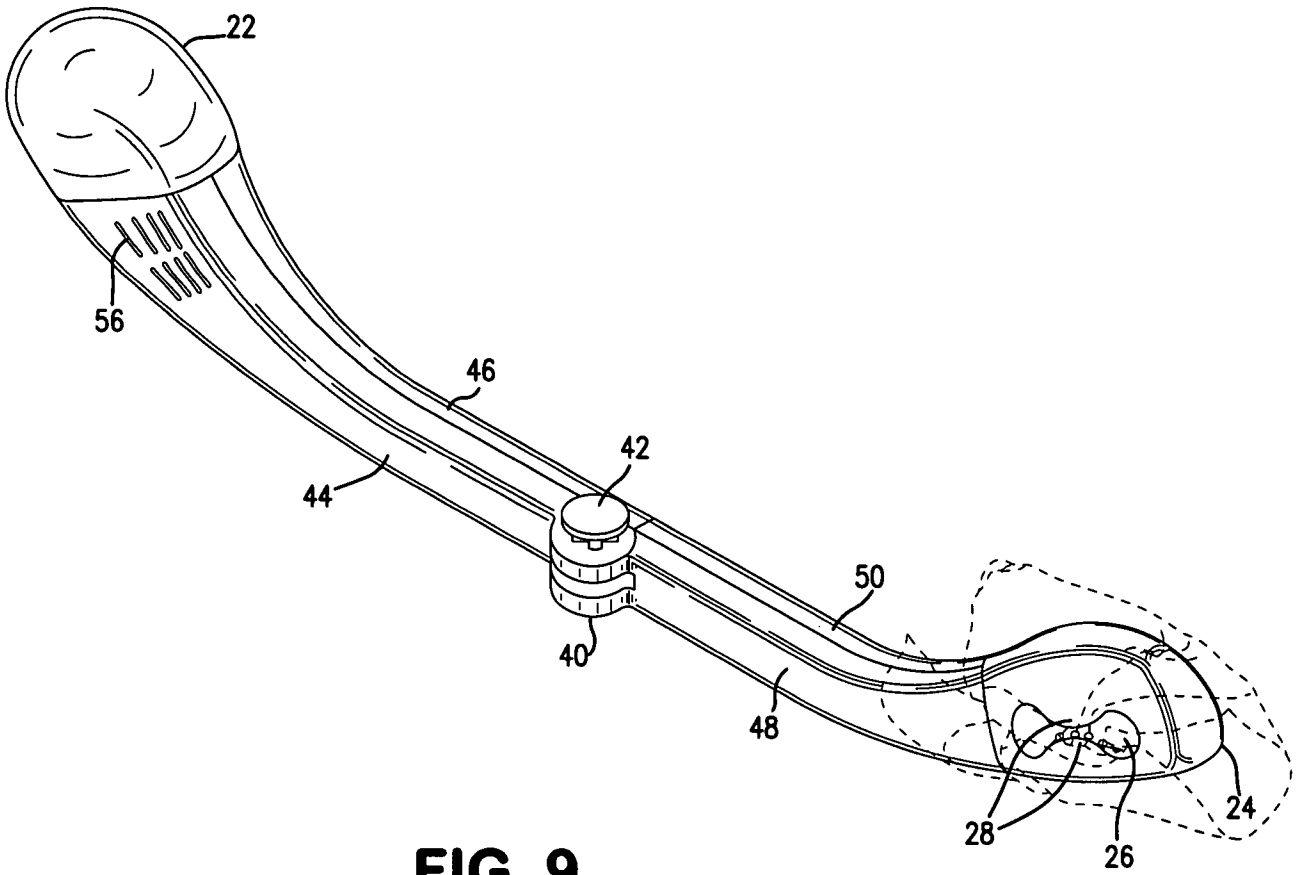
FIG. 9 is a perspective view of the personal hygiene device, according to another embodiment of the invention have one gripping element, shown holding a piece of toilet paper (shown in broken lines), ready for use.

In one embodiment of the invention, shown in particular in FIG. 9, gripping head 24 contains one gripping element 18, which in turn comprises one opening 26 and one set of internal grips 28. When the personal hygiene device of that embodiment is being used to assist a user in cleaning him- or herself while on the toilet, toilet paper is inserted inside opening 26, is gripped by internal grips 28, and then wrapped all the way around gripping head 24 before being reinserted inside opening 26, such that both ends of the toilet paper are gripped by internal grips 28.

In another embodiment of the invention, shown in particular in FIGS. 11 and 12, gripping head 24 contains two gripping elements 18. In this embodiment, gripping head 24 contains a total of two openings 26 and two sets of internal grips 28. While the personal hygiene device of that embodiment is being used to assist a user in cleaning him- or herself while on the toilet, toilet paper is inserted inside one of the two openings 26, is gripped by one set of internal grips 28, and is then wrapped half-way around gripping head 24 before being reinserted inside the other one of the two openings 26, such that each end of the toilet paper is gripped by a different set of internal grips 28. The half of the gripping head 24 that is covered by the toilet paper, is the area intended to wipe the user's soiled areas.

In FIGS. 11 and 12 gripping heads are utilized on both sides of the gripping head, each corresponding to those numbered elements shown on the left hand side of the mirrored image. In the embodiment of the invention shown in particular in FIGS. 11 and 12, in which gripping head 24 contains two gripping elements, each corresponding to element 18, and two openings, each corresponding to opening 26, each contains a back surface, corresponding to back surface 30, located behind a, pair of internal grips, such as internal grips 28. Each of the back surfaces 30 are spaced sufficiently far from each respective pair of internal grips 28, such that internal grips 28 may hold at least a portion of a wipe therewithin. As both back surfaces 30 are also part of gripping head 24, they likewise expand with increased internal fluid pressure. Back surfaces 30 are spaced sufficiently close enough to each pair of internal grips 28, such that when back surfaces 30 expand, they assist in pushing each pair of internal grips 28 sufficiently apart to release a wipe being held thereby.

In an embodiment of the invention as shown in particular in FIG. 12, each respective pair of internal grips 28 contain gripping (not piercing) teeth 32 monolithically formed on each respective pair of internal grips 28, which are aligned such that the teeth 32 press against teeth that are formed on the opposite internal grip. Teeth 32 are sized and positioned on each respective pair of internal grips 28 to focus the pressure of each pair of internal grips 28 onto teeth 32 which are holding the wipe when the internal grips 28 are in the closed position. Using teeth 32 on internal grips 28 increases the gripping capacity of internal grips 28, such that internal grips 28 may hold a heavier wipe, or may be constructed of a thinner or lighter material and still be able to hold a wipe in place during use.

In an embodiment of the invention as shown in particular in FIG. 1, personal hygiene device 20 comprises housing 34, which housing 34 is constructed of a rigid material such as a polymer which may be monolithically formed, e.g., as a single blow-molded or injection-molded part. Housing 34 should be constructed of a material that may be hygienically cleaned for repeated use. Alternatively, it may be formed from two or more components which are then joined together, e.g., by sonic welding or similar technique.

Figure 10:
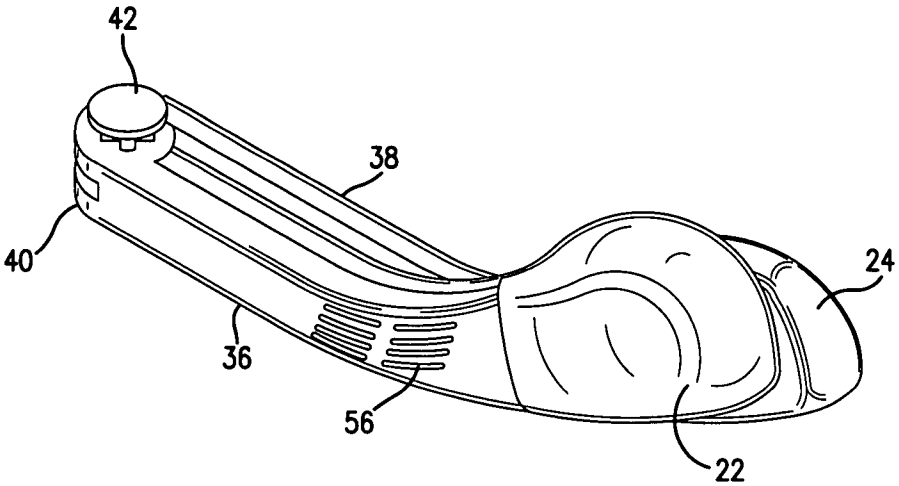
FIG. 10 is a perspective view of the personal hygiene device, according to the embodiment of FIG. 1, showing the personal hygiene device unlocked and folded for storage.

In an embodiment of the invention as shown in particular in FIGS. 1 and 10, in personal hygiene device 20, housing 34 comprises pump housing portion 36 and gripping head housing portion 38, which are then connected by hinge 40 and push lock 42, and are constructed of a rigid material, such as a polymer, which may be monolithically formed, e.g., as a single blow-molded or injection-molded part. Hinge 40 may be constructed to allow the personal hygiene device to be folded for storage, or extended for use. Push lock 42 is pushed into place by the user when the unit is in the extended position, thus locking the unit in the extended position. When locked in the extended position, the user may wipe without hinge 40 folding while in use. Alternatively, each of these parts may be formed from two or more components which are then joined together, e.g., by sonic welding or similar technique. Push lock 42 (the mechanism of which is not shown) preferably is of the kind that is spring loaded so that a first actuation sets the lock and a second actuation releases the lock. In another embodiment of the invention, a slideable lock or a threaded lock is used instead of push lock 42.

In a preferred embodiment of the invention as shown in FIGS. 2-5, pump housing portion 36 comprises right side portion 44 and left side portion 46. Pump housing portion 36 may also contain indentations or protuberances 56 located on right side portion 44 and left side portion 46, to facilitate holding personal hygiene device 20. Gripping head housing portion 38 comprises right side portion 48 and left side portion 50. Each of these parts are preferably constructed of a rigid material such as a polymer which may be monolithically formed, e.g., as a single blow-molded or injection-molded part. Alternatively, each of these parts may be formed from two or more components which are then joined together, e.g., by sonic welding or similar technique.

Figure 2:
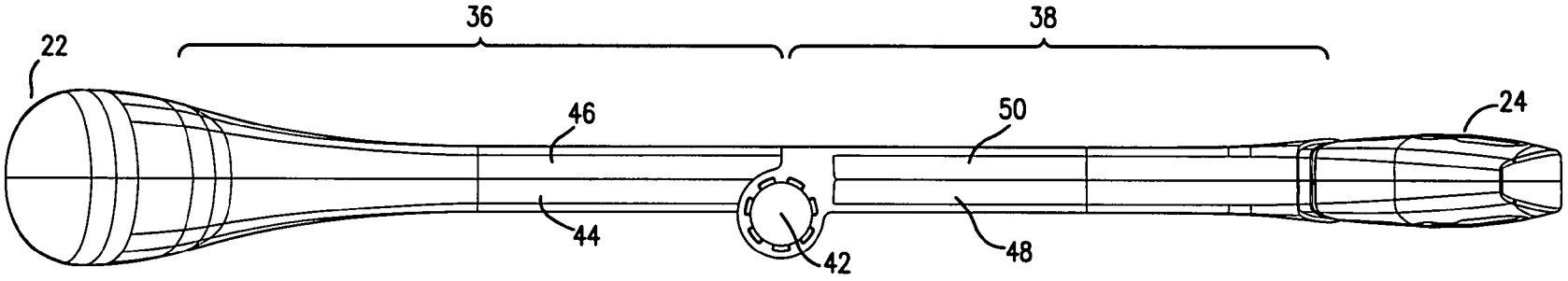
FIG. 2 is a top plan view of the personal hygiene device according to the embodiment of FIG. 1.
Figure 3:
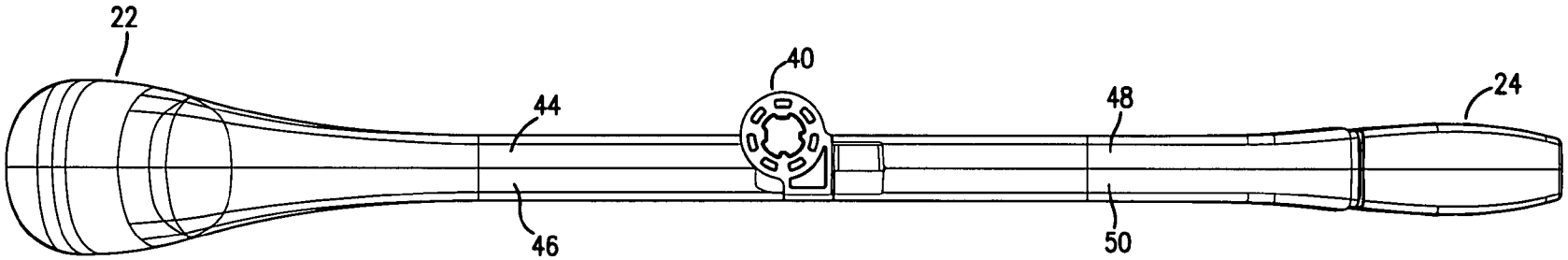
FIG. 3 is a bottom view of the personal hygiene device according to the embodiment of FIG. 1.
Figure 4:
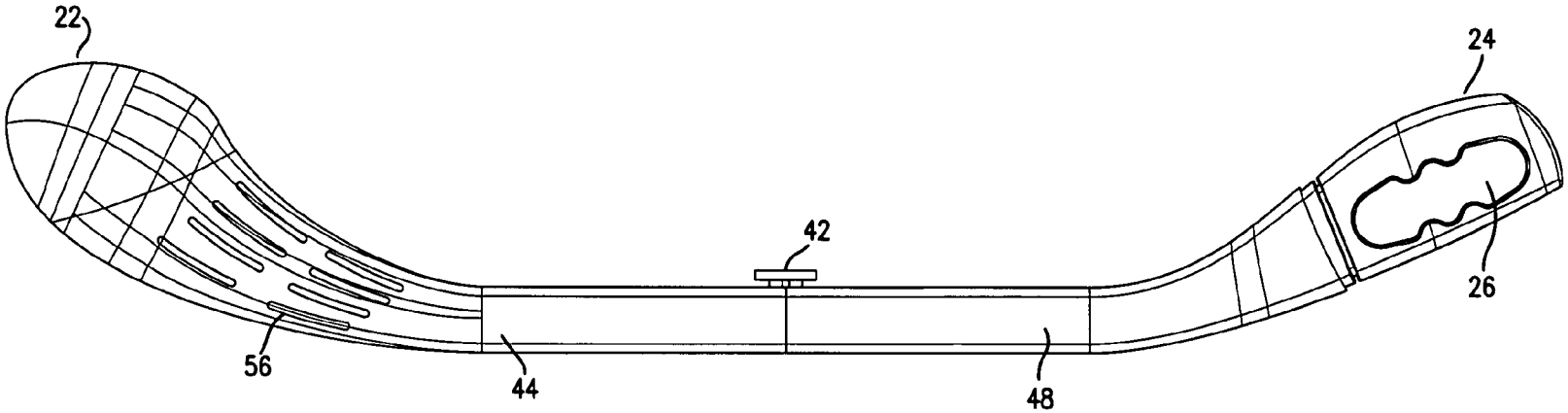
FIG. 4 is a right side elevation of the personal hygiene device according to the embodiment of FIG. 1.
Figure 5:
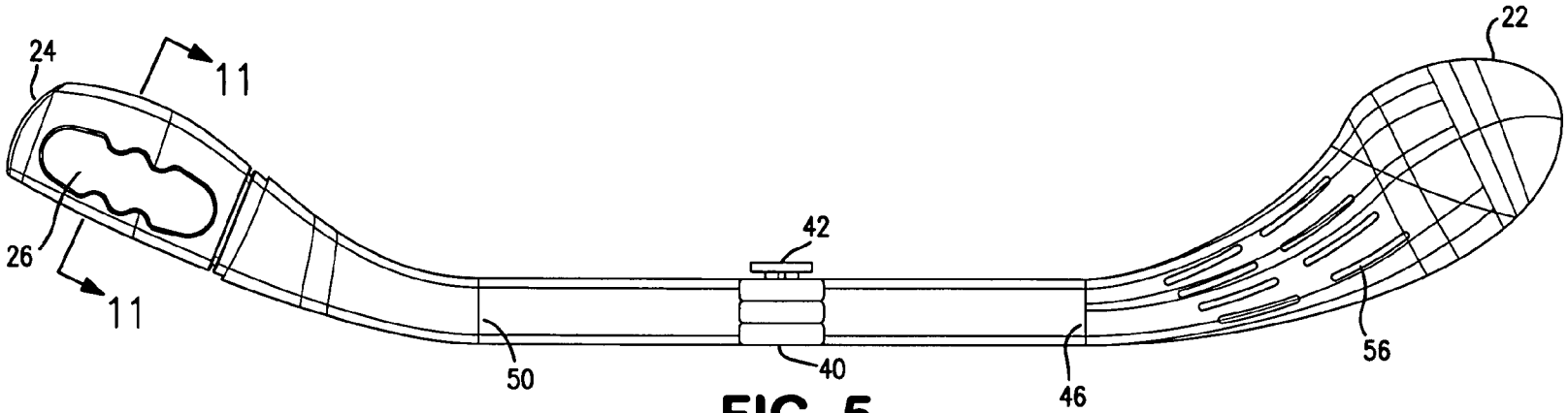
FIG. 5 is a left side elevation of the personal hygiene device according to the embodiment of FIG. 1.
Figure 8:
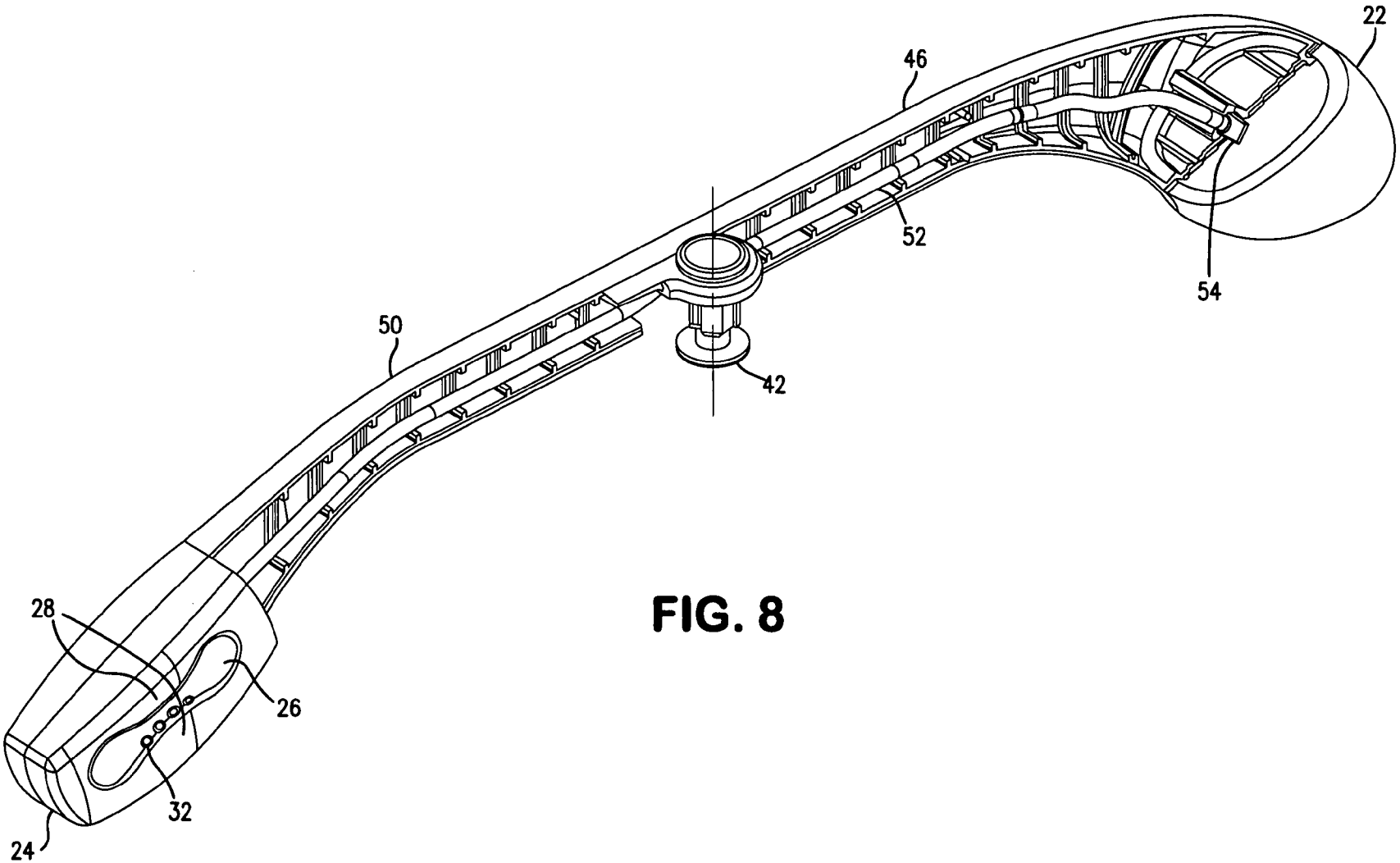
FIG. 8 is a perspective partial sectional view of the personal hygiene device according to the embodiment of FIG. 1, taken along lines 8-8 of FIG. 1, and looking in the direction of the arrows, showing the interior of the personal hygiene device, including the transmission tube, and tube fittings connecting the pump and the gripping head.

In a preferred embodiment of the invention as shown in FIGS. 1, 2 and 8, housing 34 contains transmission tube 52 as a fluid passage that connects pump 22 and gripping head 24, and allows the internal fluid, such as air, to transfer from pump 22 to gripping head 24. Transmission tube 52 is a separate part contained within pump housing portion 36 and gripping head housing portion 38. Transmission tube 52 is connected to pump 22 at one end, and to gripping head 24 at the other end, with tube fitting 54 located at both ends of transmission tube 52, to inhibit leakage of air out of transmission tube 52, pump 22, or gripping head 24, when pump 22 is squeezed to increase air pressure to gripping head 24. In another embodiment of the invention, air may be refilled to the pump 22 by use of a one way air valve, that would allow ambient air to enter pump 22 when it is expanding to its original shape, but will not allow air to escape when pump 22 is squeezed by the user.

After wiping, the user may discharge the wipe by squeezing pump 22. When pump 22 is squeezed, air, or another fluid, is forced through transmission tube 52 into gripping head 24 to increase the internal fluid pressure. Gripping head 24 is constructed such that when it contains a sufficient amount of internal fluid pressure, gripping element 18 will expand in such a manner that the wipe will no longer be held by internal grips 28, thus releasing the wipe.

While it is envisioned that ordinary atmospheric ambient air will be the fluid contained inside pump 22, gripping head 24, and transmission tube 52 at the time of manufacture, it is recognized that a wide variety of gases or liquids may be used in this invention.

The foregoing description and drawings merely explain and illustrate the invention, and the invention is not limited thereto, except as those skilled in the art who have the present disclosure before them will be able to make modifications and variations therein without departing from the scope of the invention.

The invention claimed is:

1. A personal hygiene device comprising:

a housing having first and second opposed ends;

a pump disposed at one of the first and second opposed ends for the transmission of fluid pressure;

a sealed substantially resilient gripping head disposed at the other of the first and second opposed ends, said gripping head having a gripping element capable of alternatively holding and releasing at least a portion of a hygienic wipe therewithin, in which the gripping head will hold the wipe when in the static, uninflated position, and in which the gripping head will alternatively release the wipe when the gripping head is inflated with the fluid pressure from said pump;

a fluid passage that connects the pump and the gripping head, said fluid passage allowing the fluid pressure to pass from the pump to the gripping head, to an extent sufficient to alternatively increase and decrease the internal fluid pressure therewithin said gripping head, to alternatively open and close the gripping element respectively; and the pump being operably configured, upon actuation, to increase the fluid pressure within the fluid passage, and in turn, in the gripping head, such that the gripping element will open to an extent sufficient to release the wipe, and alternatively, upon deactuation, decrease the fluid pressure to grip the wipe.

2. The personal hygiene device according to claim 1, in which the pump is sealed, and constructed of a flexible material that may be squeezed to force the fluid inside of it to increase the fluid pressure inside of the gripping head.

3. The personal hygiene device according to claim 1, in which the pump is not sealed, but, which rather permits ambient fluid to refill the pump through a one way valve in the pump.

4. The personal hygiene device according to claim 1, in which indentations or protuberances are provided on the housing adjacent to the pump, to facilitate the secure holding of the personal hygiene device by a user.

5. The personal hygiene device according to claim 1, in which the gripping head being constructed of a flexible material that expands upon the transmission of the increased internal fluid pressure, to open the gripping element to release any wipe that may be held therewithin, and the gripping element comprising an opening, internal grips, a back surface, a bottom and a top surface, and at least two side surfaces.

6. The personal hygiene device according to claim 5, in which the back surface of the gripping element is spaced sufficiently far from the internal grips of the gripping element to allow the internal grips to hold a wipe, with excess wipe captured within the gripping element, the back surface of the gripping element spaced close enough to the internal grips of the gripping element such that when the gripping head is filled with increased fluid pressure, the back surface expands to push open the internal grips to a sufficient extent to release any wipe that may be held therewithin.

7. The personal hygiene device according to claim 5, in which the gripping head contains two gripping elements, each sufficient to hold and release at least a portion of a wipe therewithin.

8. The personal hygiene device according to claim 5, in which the gripping element contains two internal grips, each proximate the opening, at opposite positions thereat, that apply a sufficient amount of pressure to hold a wipe therebetween.

9. The personal hygiene device according to claim 8, in which each internal grip further includes teeth positioned thereon that are sized and positioned so as to focus the pressure of the internal grips in direct contact with the wipe.

10. The personal hygiene device according to claim 1, in which the housing is foldable.

11. The personal hygiene device according to claim 10, in which the housing comprises a pump housing that is operably connected to the pump, a gripping head housing that is operably connected to the gripping head, and at least one hinge that is operably positioned between the pump housing and the gripping head housing, said hinge permitting the personal hygiene device to be folded for storage.

12. The personal hygiene device according to claim 11, in which at least one hinge comprises a single, pivotable joint.

13. The personal hygiene device according to claim 11, in which the user may alternatively lock the hinge in a position for use, and unlock the hinge such that the personal hygiene device may be folded for storage and portability.

14. The personal hygiene device according to claim 1, in which the fluid passage is a flexible transmission tube, for transferring fluid and fluid pressure, between the pump and gripping head.

15. The personal hygiene device according to claim 14, in which the transmission tube is connected to fittings at one end, to connect to the pump and at the other end to connect to the gripping head respectively, in such a manner to substantially prevent fluid from leaking from the personal hygiene device.

16. The personal hygiene device according to claim 1, in which the housing is shaped to be long, thin, and slightly curved to facilitate hygienic self-wiping.

17. The personal hygiene device according to claim 1, in which the housing, pump, and gripping head are constructed of materials that can be hygienically cleaned for repeated use.

18. The personal hygiene device according to claim 17, in which the pump and the gripping head are made of a substantially resilient plastic material that offers flexibility, durability, and memory.

* * * * *